United States Patent [19]

Shinopulos et al.

[11] Patent Number: 4,519,118

[45] Date of Patent: May 28, 1985

[54] HOT MILL SELF-CENTERING ROLL DESIGN

[75] Inventors: George Shinopulos, Burlington, Mass.; M. Ronald Randlett, Bainbridge; Terry F. Bower, Hudson, both of Ohio

[73] Assignee: Kennecott Corporation, Cleveland, Ohio

[21] Appl. No.: 642,727

[22] Filed: Aug. 17, 1984

Related U.S. Application Data

[63] Continuation of Ser. No. 436,659, Oct. 26, 1982, abandoned.

[51] Int. Cl.[3] ..... A01B 29/00

[52] U.S. Cl. ..... 29/121.5; 72/200; 72/236; 29/527.7

[58] Field of Search ..... 29/110, 121, 129.5, 29/130; 72/199, 200, 236, 366

[56] References Cited

U.S. PATENT DOCUMENTS

| | | | |
|---|---|---|---|
| 2,097,709 | 11/1937 | Walters | 29/130 |
| 3,021,737 | 2/1962 | Titze | 72/366 |
| 4,090,553 | 5/1978 | Beghin | 29/110 |

FOREIGN PATENT DOCUMENTS

| | | | |
|---|---|---|---|
| 47807 | 7/1978 | U.S.S.R. | 72/366 |
| 48005 | 5/1980 | U.S.S.R. | 29/110 |
| 48009 | 9/1980 | U.S.S.R. | 72/366 |

*Primary Examiner*—Lowell A. Larson
*Assistant Examiner*—Jorji M. Griffin
*Attorney, Agent, or Firm*—R. Lawrence Sahr

[57] ABSTRACT

A rolling mill, particularly one capable of forming a hot, continuously cast metallic strand into a strip with a large bite and with one pass per mill stand, uses only two small diameter rolls per stand, each mounted for rotation in a pair of chock blocks and each having a comparatively narrow, enlarged diameter working portion. The outer surface of the working portion is profiled to maintain the product centered on the rolls and to accommodate for thermal expansion. The roll also includes an internal, longitudinally extending passage that receives a flow of coolant to control its temperature.

6 Claims, 10 Drawing Figures

FIG. 2
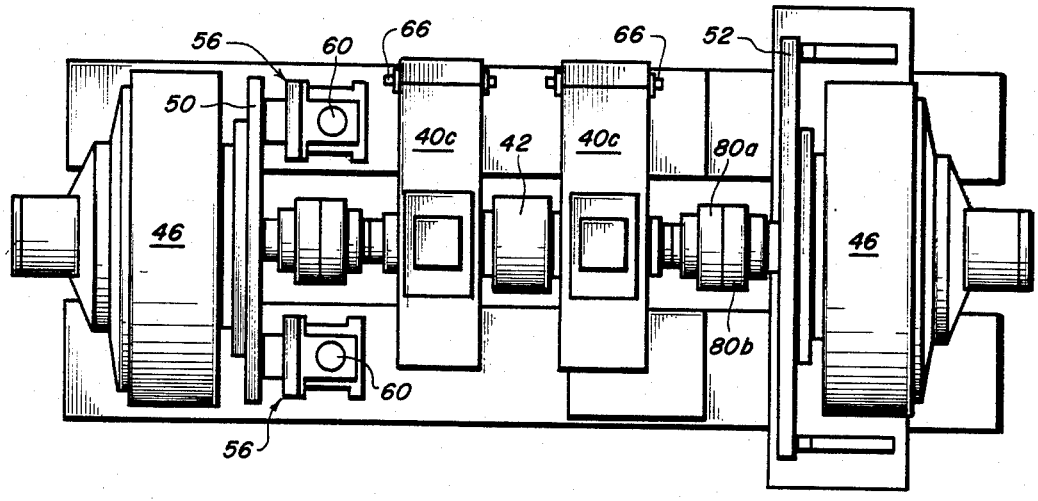
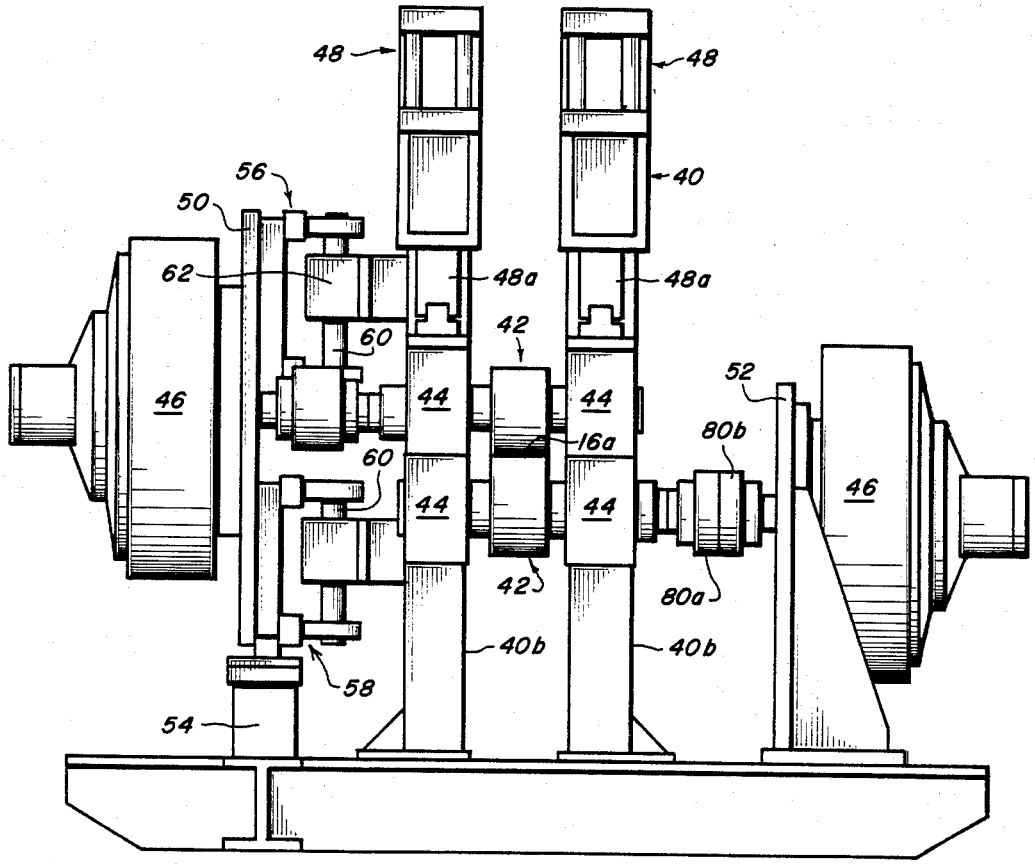
FIG. 3

FIG. 7A
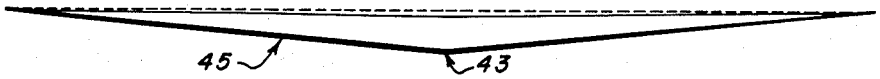
FIG. 7B
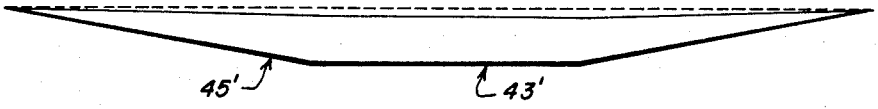
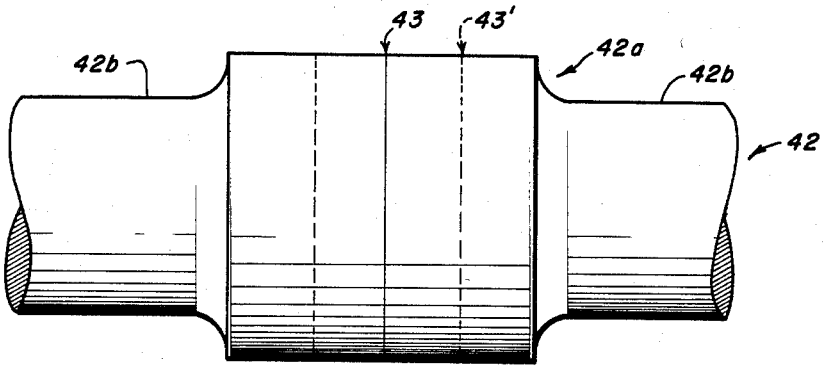
FIG. 7
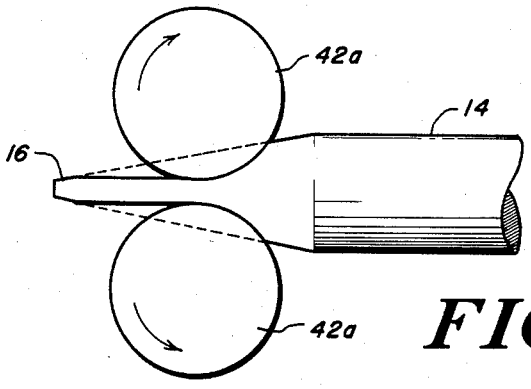
FIG. 8

HOT MILL SELF-CENTERING ROLL DESIGN

This is a continuation of application Ser. No. 436,659, filed Oct. 26, 1982, now abandoned.

BACKGROUND OF THE INVENTION

This invention relates in general to mills for rolling metal products such as strands and strips. More specifically, it relates to a roll design particularly useful in rolling a hot metallic strand into a strip of well defined dimensions and good quality that also controls the lateral location of the product on the working rolls.

A wide variety of mill stands are known for hot and cold rolling metals. Where there is a large separating force between the working rolls, whether due to a large reduction and/or to the nature of the material being rolled, there are a number of inherent design problems. One is that the rolls work against a separation force that is sufficiently large to bend or even to deform the rolls depending on the diameter, length and material of the roll as well as the nature of the material, its temperature, and the reduction ratio. The diameter of the roll is also important because for a given "bite" (thickness reduction of the product entering the mill) the "bite ratio" (roll diameter over bite) is an important factor in determining when slippage will occur between the rolls and the product. As low a ratio as possible is desired to minimize roll size (and therefore roll cost) and/or maximize bite. Typical bite ratios for mills currently in use are in the range of 50:1 to 100:1. Another consideration is that larger diameter rolls produce a greater spread, however, the attendant separation force is also larger. Ideally the roll design should produce the desired spread with the minimal separation force.

Heretofore, in order to deal with large separation forces (e.g. in excess of 100,000 lbs/stand), it has been necessary to use a four high mill, that is, one with two working rolls and two "back up" rolls that provide mechanical support for the working rolls. Such mills are also characterized by a quite heavy, expensive frame that can accommodate all four rolls and resist the large forces generated by the rolling. U.S. Pat. Nos. 3,103,138; 3,391,557; 3,550,413 and 3,568,484 are exemplary of such four high mills stands. While certain mills produce a high reduction by passing the product through the mill multiple times, this is not possible in a continuous, on-line casting and rolling operation. (For example, rolling operations with twenty passes are not uncommon.)

Frequently the gap of the mill is adjustable to produce an output strip that has a uniform gauge even though the gauge, temperature or metallurgical qualities of the input product may vary. The aforementioned patents, for example, describe arrangements for varying the gap. More sophisticated systems produce a control signal that adjusts the gap in response to a sensed deviation in the gauge of the rolled product from a preset value. Many systems use hydraulic cylinders that act either with or against the separation force to provide this adjustment. The hydraulic system, however, has heretofore been a significant complicating factor when the rolls must be replaced, whether due to ordinary wear, damage or to accommodate a different product run. U.S. Pat. No. 3,864,955, for example, discusses the importance of roll changes and describes an arrangement which attempts to facilitate roll replacement. U.S. Pat. No. 3,323,344 discloses another arrangement.

However, known systems, for conventional four high mills require hours to replace rolls. This time represents a significant loss of productivity for the rolling operation. Where the product being fed to the mill is continuously cast, the roll change will shut down the entire production line.

The torque and speed of rotation of the rolls are also important in producing a high reduction without slippage. More specifically, in order to hot roll copper and brass strand with a large bite (e.g. in excess of 1 inch) and a low bite ratio (e.g. 7:1), the drive system for the working rolls must have a comparatively high torque (typically in excess of 1,000 ft-lbs.) to achieve a large bite and a comparatively low speed (typically less than 400 rpm) to couple the rolling mill speed to that of the caster. In addition, it is necessary to vary these parameters depending on the particular product being run and other factors such as the roll diameter. Heretofore mill stands requiring a variable high torque at a low speed have used electric motors with a reducing gear train. This arrangement provides the required operating characteristics, but it is a costly system that takes up a comparatively large amount of space that dominates the mill itself.

Torque requirements are also interrelated with other design factors such as roll diameter and anticipated separation forces and thus, size and cost of the mill, the gauge of the rolled product and friction. Heretofore the lower rolling force of small diameter rolls and their ability to roll thin gauge products has generally been balanced against offsetting considerations through the use of back-up rolls. If two rolls are used where substantial separation forces are produced, prior art mills have used costly, massive rolls with very large diameters, e.g. two to three feet. Heretofore, high reduction rolling using unsupported (two high) small diameter rolls (less than at least one foot in diameter) has not been commercially practical. U.S. Pat. No. 4,218,907 describes a two high mill which provides operating characteristics only achievable previously with four high mills. However, this two high mill requires a special bearing assembly which supports the rolls over all or most of their length.

Other design problems arise from the fact that the material being rolled is hot. One well known problem is that the hot strip product will heat the working rolls and cause their contours to change due to thermal expansion. This in turn can cause changes in the gauge and profile of the rolled strip. U.S. Pat. No. 4,262,511 describes as a solution a system that distributes a coolant over the rolls in response to a signal indicative of the shape of the rolled product. Other systems simply adjust the mill gap to accommodate for temperature changes. In cold rolling, profiled rolls have been used. No known systems, however, have produced a strip product having consistently uniform dimensions where the input to the mill is a very hot strand that is not already in a strip form. When hot rolling thin gauge materials with a high thermal conductivity, it is also important not to quench the material with the rolls while at the same time not overheating the strip or the rolls from an input of mechanical energy.

Another problem in rolling operations, particularly hot rolling operations on a continuous strand/strip product, is that the strand or strip usually develops or is subjected to significant forces that tend to move the product laterally with respect to the rolls. Various mechanical guides and restraints are known. However, none have proven to be highly effective in controlling this problem because the mechanical guide or restraint is spaced from the point where the rolls engage the product. This spacing allows the product to move in response to the forces once it passes the guide or restraint. Also, many guides or restraints do not closely control the lateral position of the strands even at the guide member.

It is therefore a principal object of this invention to provide a roll for a metal, particularly a hot rolling mill that rolls a continuously cast hot metallic strand into a narrow strip, where the rolls are designed to self-center the strand or strip on the working portion of the roll.

Another major object of this invention is to provide a hot rolling mill utilizing such rolls where the mill is only two high and uses small diameter rolls yet is capable of producing a high reduction with precisely controlled dimensions and profile of the rolled strip product.

A further object of this invention is to provide a hot rolling mill utilizing rolls with the foregoing advantages that also accommodate for the thermal expansion caused by working a hot material.

SUMMARY OF THE INVENTION

A rolling mill and roll design according to the present invention receives continuously cast, hot metallic strand, particularly strands of copper and copper alloys, and produces a high quality narrow strip with precisely controlled dimensions, profile and camber and with a high reduction. The mill has only two working rolls with a comparatively small diameter, each mounted for rotation in chock blocks. One roll is fixed and the other roll and its chock blocks are movable vertically under the control of a pair of hydraulic cylinders to vary the gap between the rolls. The chock blocks are mounted in a generally rectangular frame assembly that includes vertical members that mount the chock blocks and upper members that span the vertical members. For copper and brass, this mill can produce a bite in excess of one inch and approaching two inches and bite ratios of as low as 5:1 without slippage.

Each roll has a narrow, enlarged diameter rolling portion that controls the hot metallic strand. The outer surface of this working portion has an inverse "crowning" or concave contour along its working length, preferably with a generally V-shaped contour. After thermal stabilization, the outer surface of the roll produces a rolled product that either is uniform or has slightly more material at its center than its edges. This design has been found to be effective in controlling the lateral position of the strand. An internal passage conducts a flow of a cooling liquid (water) through the roll. Roll thickness is adequate to maintain a hot roll surface temperature, thus preventing quenching of the rolled strip.

These and other features and objects of the present invention will be better understood from the following detailed description which should be read in light of the accompanying drawings.

BRIEF DESCRIPTION OF THE DRAWINGS

FIG. 2 is a top plan view of the first mill stand shown in FIG. 1 with frame portions, rotary brushes, entrance and exit guides, and gauges removed for clarity;

FIG. 3 is a view in front elevation of the mill stand shown in FIG. 2;

FIG. 7 is a detailed view of the working portion of the rolls shown in FIGS. 2–6;

FIG. 7A is an enlarged view of the profile of the outer surface of the roll working portion shown in FIG. 7 that accommodates thermal expansion and self-centers the strand or strip being rolled;

FIG. 7B is a view corresponding to FIG. 7A of an alternative profile; and FIG. 8 is a highly simplified view in side elevation showing the action of the rolls of the first mill stand to affect a very high reduction of an incoming cast rod into a narrow strip.

DETAILED DESCRIPTION OF THE PREFERRED EMBODIMENTS

Figure 1:
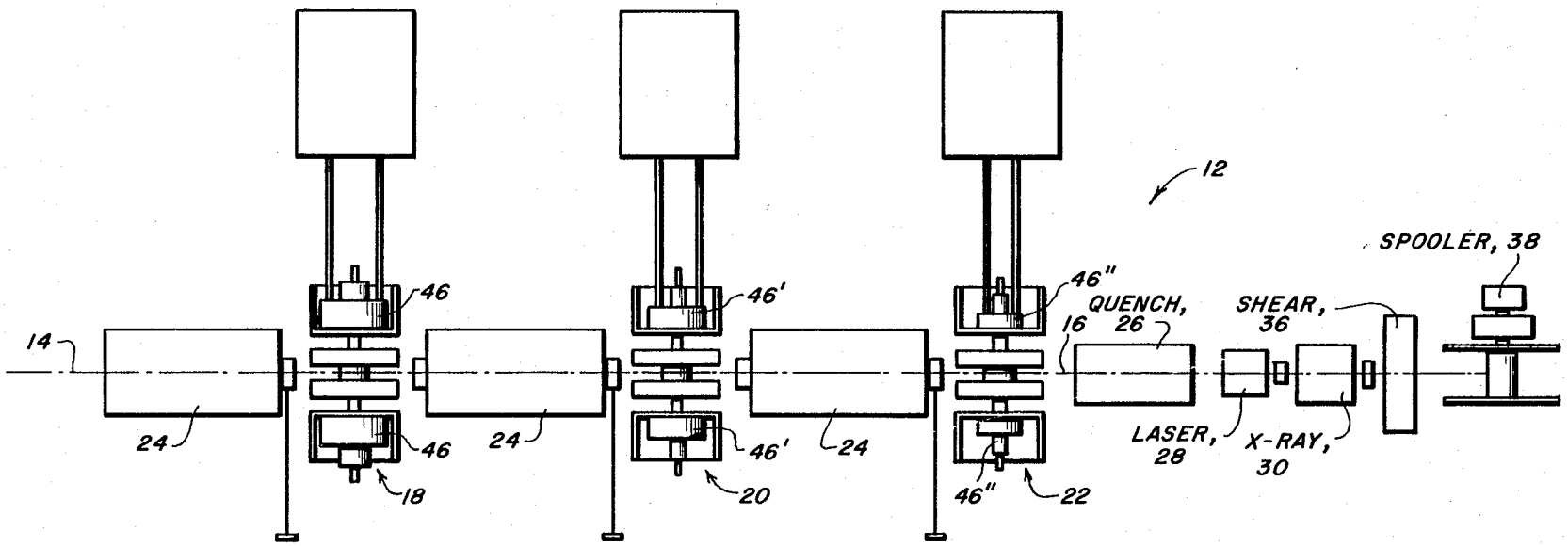
FIG. 1 is highly simplified top plan view of a tandem hot rolling mill operation according to the present invention.

FIG. 1 shows a tandem hot rolling line 12 that receives a continuously cast metallic strand 14 and reduces it to a narrow strip 16 of accurately controlled width and gauge. While this line can hot roll a wide variety of metals and strands having a variety of cross-sectional shapes, it will be described herein with respect to its preferred use, the continuous hot rolling of copper and copper alloy rod having a circular cross section into a narrow strip. This rod is preferably supplied directly from a continuous casting operation of the type described in U.S. Pat. Nos. 4,211,270 and 4,301,857, the disclosures of which are incorporated herein by reference. This rod leaves the caster red hot and advancing at speeds that are usually in the range of 30 to 300 inches per minute (ipm) depending on the diameter of the rod being cast and the desired production line speed.

The line 12 includes first, second and third hot rolling mill stands 18, 20 and 22, respectively. Each stand is preceded by a gas-fired reheating furnace 24 that raises the temperature of the strand 14 or strip 16 to the desired rolling temperature, typically 1400° F. The separation between adjacent stands is sufficiently short that the strip will not cool substantially (or require long reheating furnaces), but long enough that the speed and gap controls on each stand are able to adjust without adversely affecting the strip, e.g., causing unstable plastic flow. After the strip leaves the third stand 22 it is cooled in a closely coupled quench tank 26 to control oxidation. A gauge area including a laser width gauge 28 and an x-ray thickness gauge 30 follow the quench tank. Width gauges 28 are also mounted at the exit of the last mill stand to provide an immediate measure of the width of the strip 16 as it leaves the mill. Each of these instruments generates a measurement signal that is used to control the operation of the line 12. Each mill also preferably has a two-color infrared pyrometer (not shown) mounted to measure the temperature of the strip as it enters the mill. The line terminates with a shear 36 and a spooler 38. The shear is used primarily to remove portions of strip that do not meet set tolerances, for example, the initial portion of a strip when the line starts up before the rolls have fully adjusted to a steady state operating condition. The spooler 38 collects the strip 16 in an even, level wound coil on a core.

With particular reference to FIGS. 2—3, each rolling mill stand 18, 20 and 22 has substantially the same construction. This invention therefore will be described with reference to the first mill stand 18. (Like parts are identified with the same reference number, but common parts associated specifically with the second mill are noted with a prime (') and parts associated with the third mill are noted with a double prime ("). Unprimed numbers refer to parts of the first mill stands which will be described in detail). The mill stand 18 is organized around a frame assembly 40 formed primarily of steel I-beams in a generally rectangular array around the passline 16*a* of the strip 16. Two rolls 42, 42 are each mounted in associated chock blocks 44,.44 for rotation. The rolls are formed of the material sold under the trade designation Astrolly hipped on a tool steel base. Other suitable materials are the material sold under the trade designation Waspaloy and cemented tungsten carbide.

A hydraulic motor 46 drives each of the rolls 42, 42. Hydraulic cylinders 48, 48 acting through rods 48*a*, 48*a* and the upper chock blocks 44, 44 position the upper roll and apply the necessary downward force to offset the separation force generated by rolling the strip. The cylinders 48 are preferably five-inch diameter with a four-inch stroke and a two-inch diameter rod capable of operating with applied fluid pressures of 3,500 psi to generate downward forces of 70,000 lbs per cylinder or 140,000 lbs per stand. The cylinders also preferably include an internal ultrasonic distance measuring device which can measure vertical movement of the rods 48*a* with a resolution of 0.0001 inch. Of course, other standard, commercially available displacement measuring devices such as linear variable differential transformers can be used, but with some loss of accuracy. The cylinders 48, 48 are each controlled independently to vary the profile of the strip 16.

The frame 40 includes four of the side members 40*b* disposed in pairs to locate and support the chock blocks 44, 44 laterally. However, all four chock blocks 44 can slide vertically within the members 40*b*. The frame 40 is capped by two upper frame beams 40*c*, 40*c* that extend in the direction of travel of the strip to bridge one member 40*b* to another member 40*b* on the opposite side of the rolls. The frame 40 is compact, comparatively lightweight, yet strong assembly that is capable of containing the separation forces of rolling. (If excessive separation forces are generated, a shear pin which connects each rod 48*a* to one of the blocks 44 will shear to protect the frame.) A maximum value for the separation forces encountered in hot rolling copper or brass with a high reduction (large bite) is 140,000 lbs. Stated in other terms, each frame should be able to withstand separation forces that produce pressure in the range of 2,000 to at least 3,500 psi. It should be noted that the strength of the frame assembly 40 in combination with the ability to adjust the position of the movable roll accurately and quickly using the cylinders 48 avoids the need for a massive, stiff and quite expensive frame which is common in prior art rolling mills that are subjected to large separation forces.

Figure 4:
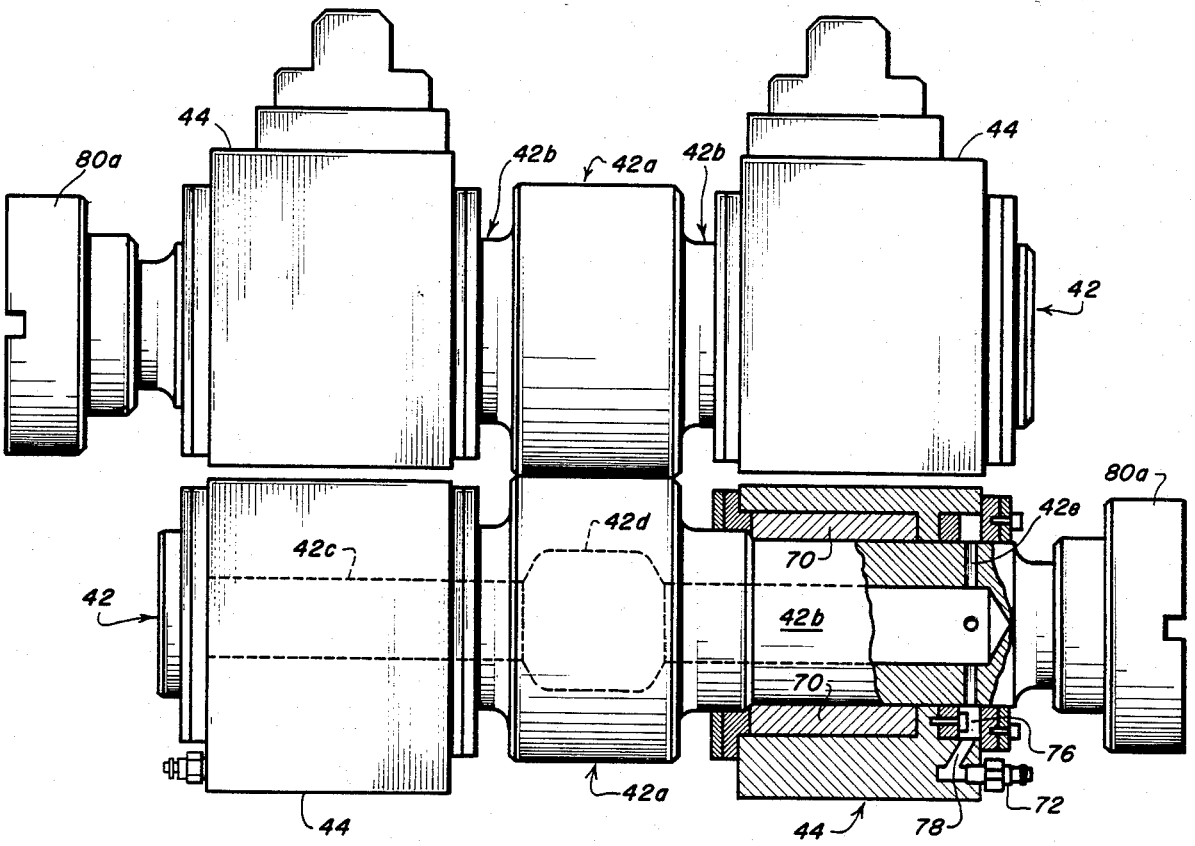
FIG. 4 is a detailed view in front elevation of the rolls and their associated chock blocks shown in FIGS. 2 and 3 with the right lower chock block shown in vertical section.
Figure 5:
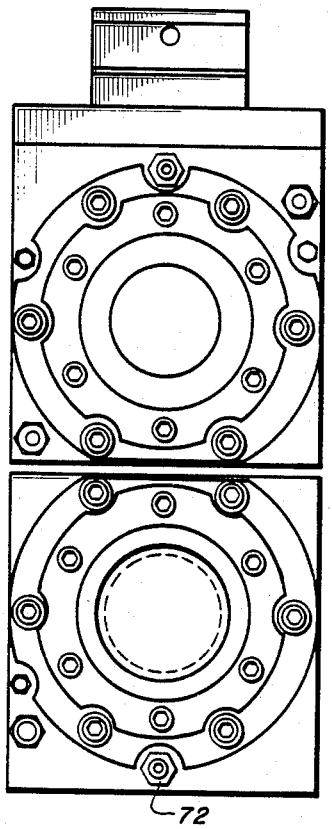
FIG. 5 is a view in side elevation of the chock blocks shown in FIG. 4.
Figure 6:
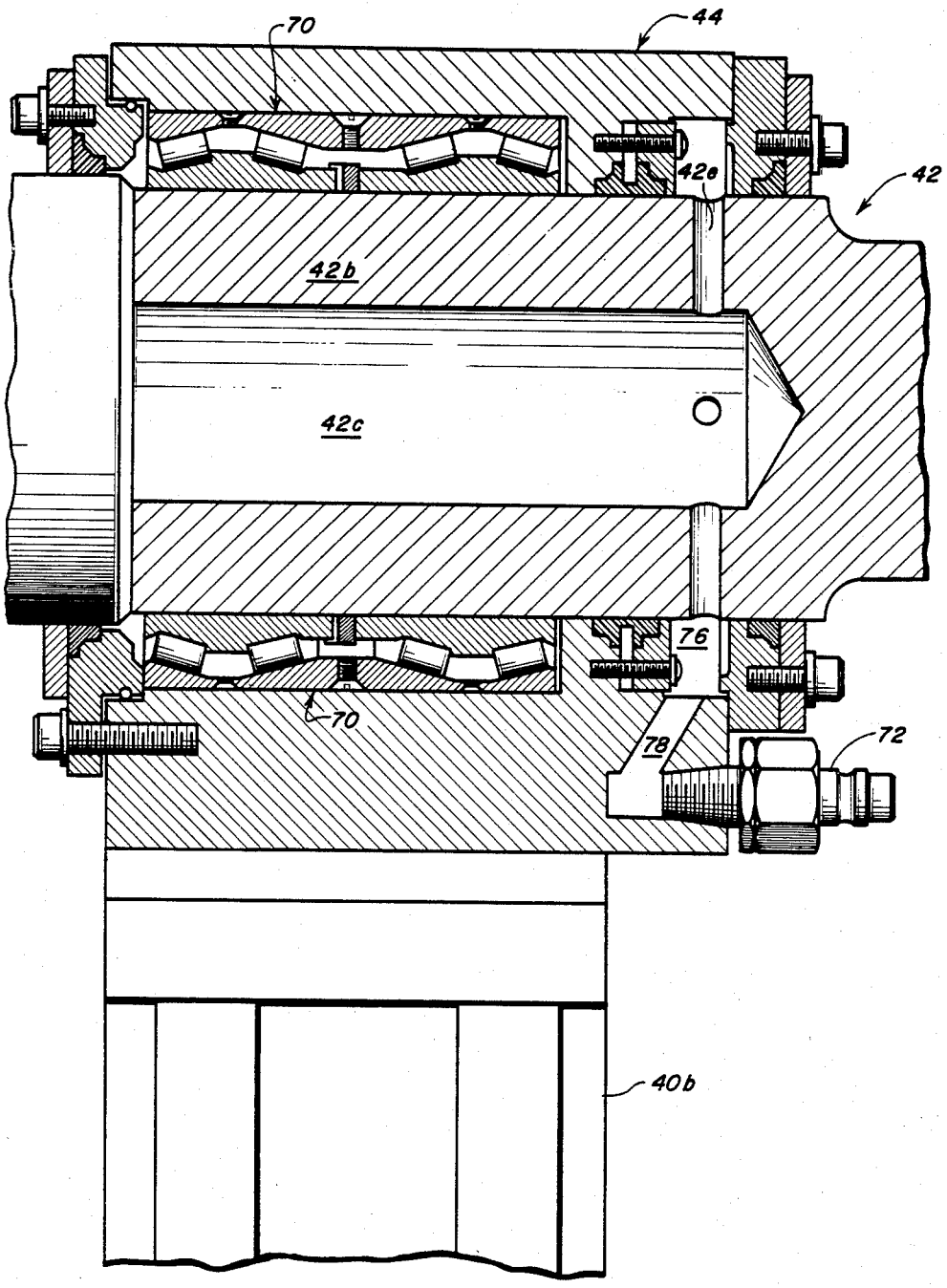
FIG. 6 is a detailed view in vertical section of the chock block shown in FIGS. 4 and 5 and the roll portions supported in that chock.

With reference principally to FIGS. 4 and 7, the rolls 42 of the present invention are characterized by a relatively narrow central working portion 42*a* having an enlarged diameter as compared to neck portions 42*b*, 42*b* journalled in bearing assemblies 70 mounted in each chock block 44. However, the diameter of even this "enlarged" working portion 42*a* is small, less than a foot and typically five to seven inches, as compared to conventional two high rolls used in "break down" mills where there is a substantial reduction in the thickness of the product being rolled and there are large separation forces. The enlarged diameter is particularly important in the rolls of the first mill 18 because the degree to which the strand is spread into a strip configuration is a function of the diameter of the working portion of the roll that engages the strand, with larger rolls giving more spread; but the roll load that develops is less for smaller rolls. Thus, rolls must be large enough for bite and adequate spread, but small enough to prevent excess loading and excess roll cost.

It is quite important that the outer working surface of each portion 42*a* is inverse "crowned," that is, it has a concave profile receding, when the roll is cold, to a point of maximum depression 43, 43' that is centered on the passline of the strand or strip being rolled as shown in FIGS. 7A and 7B, respectively. As shown in a heavy solid line in FIG. 7A, the profile 45 for the rolls in the first mill 18 is preferably V-shaped along the longitudinal axis of the roll. In the second and third mills 20 and 22, the profile 45 is preferably a truncated V-shape as shown in a heavy solid line in FIG. 7B, that is, with sloped sides that meet at a central portion with a constant diameter. The precise contour depends on the thermal response of the roll and the size, shape and temperature of the product being rolled. In any event, after thermal stabilization, the outer surface of the portion 42*a* is generaly flat, but with a slight recess near the center point (light line profiles in FIGS. 7A and 7B) to produce a rolled product that has slightly more material near its centerline than its edges.

This roll design, which results in a rolled strip with a slightly "fat" middle portion, has been found to be surprisingly effective in holding the product centered laterally on the rolls despite the presence of sometimes substantial tendency for the strand or strip to "wander" laterally otherwise. This control has been found to be so effective that centering guide rolls at the entrance side of the mill are preferably used only on the second and third mill stands 20 and 22 where this profiling must be reduced in order to produce a final output product with a uniform gauge across its width. By way of illustration only, the rolls of the first mill stand have a central working portion with an edge diameter of 7.375 inch (cold) that recedes to a minimum diameter of 7.365 inch (cold) at the strand passline 16*a* which is normally coincident with the point 43. At the second mill stand, a typical roll has a working portion with a diameter of 5.875 inch (cold) that recedes to a central area, the point 43', with a constant minimum diameter of 5.867 inch (cold).

Another factor in the thermal response of the roll is the degree to which the roll is colled. In the present invention, the roll has an internal, longitudinally extending passage 42*c* that conducts a flow of cooling water from a "quick disconnect" inlet 72 in one chock block to a "quick disconnect" outlet 74 in the opposite chock block. The passage 42*c* preferably has an enlarged central volume 42*d* within the roll portion 42*a* to increase the cooling at this portion. The cooling water is directed from the inlet and outlet to the passage 42*b* via radial channels 42*e* in the neck portions of the roll, an annular passage 76 in the chock block, and a passage 78. A typical flow rate for the cooling water is four gallons per minute for each roll. Preferably the flow in each of the rolls 42, 42 is in opposite directions so that the strip will be exposed to similar cooling across its width. Those skilled in the art will appreciate that the chocks 44, 44 provide a compact support for the rolls while at the same time providing continuous lubrication and a rotary union for the introduction of the cooling liquid into the roll.

It should be noted that the working area of the rolls 42, 42 span a comparatively small distance between the chock blocks 44, 44. Stated conversely, most of the roll length is taken up by the neck portions 42*b*, 42*b* which are supported almost along their entire length by the chock blocks and the associated bearing assemblies. This geometry is a principal reason that a small diameter roll design works despite the substantial separation forces that are present. It should also be noted that a small side clearance is designed into each roll to accommodate lengthwise thermal expansion, but to limit the lateral movement of the roll once it is at its usual operating temperature.

In operation the line 12 continuously hot rolls a metallic strand 14 into a strip 16 (FIG. 8) having a highly uniform configuration and a recrystallized grain pattern. The line preferably operates to roll copper or copper alloy rod into narrow strips. In addition to rolling the strand or strip, each mill, and in particular the first mill 18, act as drives for the strand or strip.

There has been described a novel roll design that is particularly useful in a two high hot rolling mill. Despite having a comparatively small diameter, the rolls can produce the narrow strip of copper or copper alloys from a continuously cast strand. The rolls are self-centering to control the lateral position of the strand or strip. They also accommodate for thermal expansion. The rolling is characterized by a large bite with only one pass for each mill stand. The strip material has a recrystallized grain pattern and the final product has precisely controlled dimensions with a uniform gauge.

While the invention has been described with reference to its preferred embodiment, it will be understood that various variations and modifications will occur to those skilled in the art from the foregoing detailed description and the accompanying drawings. Such variations and modifications are intended to fall within the scope of the appended claims.

What is claimed is:

1. In a roll for hot rolling a continuously cast metallic strand into a substantially flat, narrow strip, the improvement comprising a central working portion that engages the strand and strip across the entire width of said strand and strip, the outer surface of said working portions having a longitudinal profile that is slightly concave with a maximum depth at the central region of the roll working portion with the depth of profile concavity being less than 0.3% of the maximum diameter of the roll such that after thermal stabilization there is a slight remaining concavity that produces a strip with slightly more metal at its center than at its edges to control the lateral location of the strand and strip on said working portion, said working portion having a larger diameter than adjacent end portions of the roll and a considerably shorter length than said adjacent end portions.

2. The roll design improvement according to claim 1 wherein said profile has a generally V-shaped configuration.

3. The roll design improvement according to claim 1 wherein said profile has a truncated V-shaped configuration.

4. The roll design improvement according to claim 1 wherein said roll has an internal longitudinally extending passageway for a flow of a cooling fluid through the roll.

5. The roll design improvement according to claim 1 wherein said working portion has a diameter less than one foot.

6. The roll design improvement according to claim 5 wherein said working portion diameter is in the range of 5 to 8 inches and said maximum depth of the profile concavity is approximately 10 mils.

* * * * *